US005727076A

United States Patent [19]

Paddock

[11] Patent Number: 5,727,076

[45] Date of Patent: Mar. 10, 1998

[54] AUDIO TRANSDUCER HAVING PIEZOELECTRIC DEVICE

[75] Inventor: Paul W. Paddock, McMinnville, Oreg.

[73] Assignee: Aura Systems, Inc., El Segundo, Calif.

[21] Appl. No.: 236,209

[22] Filed: May 2, 1994

[51] Int. Cl.[6] ..... H04R 25/00

[52] U.S. Cl. ..... 381/190; 381/174; 381/202; 381/196

[58] Field of Search ..... 381/190, 202, 381/203, 196, 114, 173, 191; 310/324, 348, 328; 29/594

[56] References Cited

U.S. PATENT DOCUMENTS

| | | | |
|---|---|---|---|
| 1,803,275 | 4/1931 | Sawyer | 381/190 |
| 3,548,116 | 12/1970 | Schafft | 381/190 |
| 3,941,932 | 3/1976 | D'Hoogh | 381/190 |
| 4,029,911 | 6/1977 | Albinger | 29/594 |
| 4,584,439 | 4/1986 | Paddock | 179/115.5 |
| 4,903,308 | 2/1990 | Paddock et al. | 381/202 |
| 5,054,063 | 10/1991 | Lo et al. | 379/452 |
| 5,249,237 | 9/1993 | Paddock | 381/194 |
| 5,450,497 | 9/1995 | Paddock | 381/202 |

FOREIGN PATENT DOCUMENTS

| | | | |
|---|---|---|---|
| 0182999 | 10/1983 | Japan | 381/190 |
| 0143099 | 7/1985 | Japan | 381/190 |

*Primary Examiner*—Sinh Tran
*Attorney, Agent, or Firm*—Kathy Mojibi

[57] ABSTRACT

An audio transducer is disclosed that has a piezoelectric driving element and a diaphragm having a sheet configured as a flat, curvilinear plane. A lightweight, rigid bridge element connects the piezoelectric device to the diaphragm. Several bridge configurations are shown that emphasize or reduce various characteristics such as frequency response and vertical dispersion. Also, several diaphragm configurations are disclosed in which the diaphragms have as few as a single diaphragm sheet or as many as four sheets. In each case the diaphragm sheets are configured as a flat, curvilinear plane.

26 Claims, 6 Drawing Sheets

FIG. 16
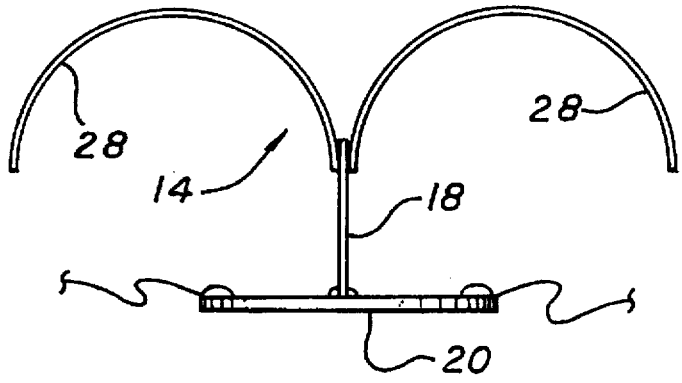
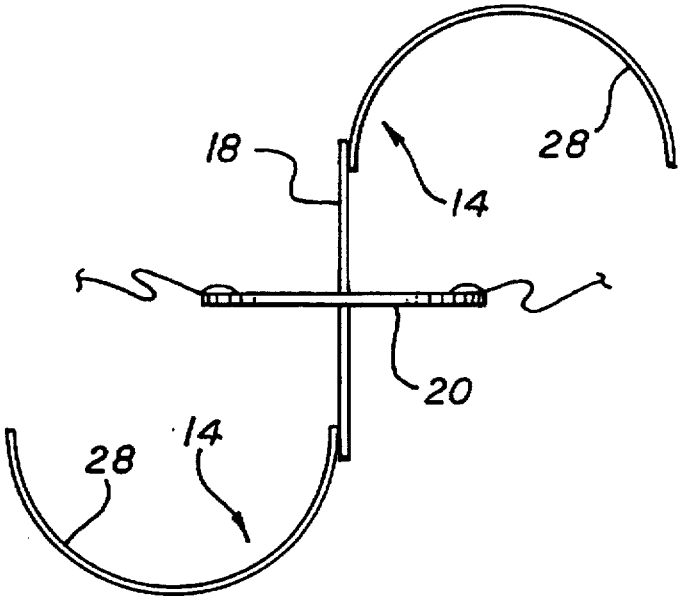
FIG. 17
FIG. 18
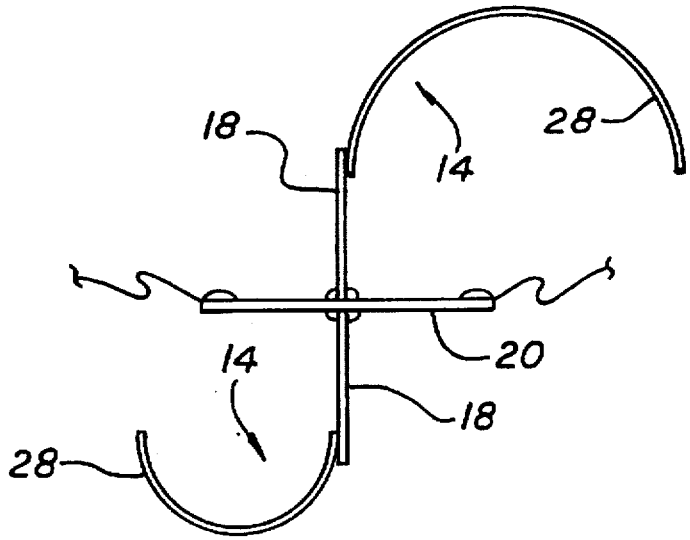

AUDIO TRANSDUCER HAVING PIEZOELECTRIC DEVICE

BACKGROUND OF THE INVENTION

1. Field of the Invention

The present invention pertains to the field of audio transducers and more particularly to the field of audio loudspeakers using a piezoelectric device as a driver.

2. Description of the Related Art

Modern piezoelectric devices are a very reliable and inexpensive means of converting electrical energy into physical motion and exhibit a high tolerance of environmental factors such as electromagnetic fields and humidity.

Accordingly, piezoelectric devices are a logical choice for use in audio transducers. However, to date no one has been able to construct a practical piezoelectric audio loudspeaker having good fidelity characteristics. Although piezoelectric devices have a good frequency response, designers have had limited success in coupling a piezoelectric device to an acoustical diaphragm for producing sound in the manner that produces a high fidelity speaker or microphone. Conversely, piezoelectric devices have been successfully used in audio transducer devices that produce a single tone or a limited range of frequencies, such as beepers and audio warning signals associated with electronic devices.

Another field of art related to the present invention are audio transducers having controlled flexibility diaphragms such as are disclosed in Paddock, U.S. Pat. No. 4,584,439, Paddock et al., U.S. Pat. No. 4,903,308, and Paddock, U.S. Pat. No. 5,249,237. The audio transducers of the above-referenced patents all share the characteristic of having a tangentially driven diaphragm. That is, the diaphragms are comprised of two or more sheets having flat, curvilinear plane surfaces which are joined together to form a tangent plane, at the junction of the sheets, that is tangent to a curve along both curvilinear planes. The diaphragm is then driven along that tangent plane.

The foregoing transducers have a wire coil which is driven by a permanent magnet assembly arranged to create a magnetic flux orthogonal to the tangent plane and the wire coil. When an audio signal current is supplied to the wire coil a magnetic flux is established which interacts with the permanent magnets causing relative movement between the two, thus driving the diaphragm. The audio transducers of the above-referenced patents all use, and are therefore sensitive to, magnetic fields. Further, the electro-magnetic drivers of the above-referenced patents are more expensive and fragile than most piezoelectric devices.

Accordingly, there is a compelling need for a piezoelectric driven audio transducer for producing sound of higher fidelity than prior piezoelectric audio transducers.

SUMMARY OF THE INVENTION

The present invention solves the above-noted deficiencies by providing a tangentially driven diaphragm speaker incorporating a piezoelectric device. A preferred embodiment of the present invention uses a diaphragm having two sheets supported by foam supports. The diaphragm sheets are configured in a convolute configuration which is generally referred to herein as a flat, curvilinear plane, defined as a surface formed by a straight line moving transversely through space along a curved path. The sheets are connected to a bridge, which in turn is connected to a piezoelectric device. The diaphragm, foam supports, bridge and piezoelectric device are preferably mounted in an enclosure. The bridge is preferably a thin, lightweight, rigid structure that transfers a point source of motion to a line, thereby transferring the piezoelectric point source of motion to a line source of motion for tangentially driving the diaphragm.

Preferably the bridge has a generally triangular shape with a line of perforations along a long margin. Alternative embodiments of the bridge are provided to customize various response characteristics of the loudspeaker. Additionally, a bridge may be converted to a low pass filter by placing a foam pad between the bridge and the piezoelectric device to attenuate higher frequencies.

Other alternative embodiments include diaphragms having a single flat, curvilinear plane sheet and diaphragms having more than two flat, curvilinear plane sheets. One alternative embodiment includes mounting a bridge structure onto both sides of a piezoelectric device and simultaneously driving opposed diaphragms.

Further alternative embodiments include bridges having multiple apexes wherein piezoelectric devices are mounted on the tip of each apex to drive the diaphragms. The piezoelectric devices may be of different sizes, thereby providing different frequency responses. For example, a larger piezoelectric device might provide a midrange response while a smaller piezoelectric device provides a higher frequency, tweeter response. In such applications having multiple piezoelectric devices, it is not necessary to provide crossover circuitry because all the piezoelectric devices may be driven directly from the same audio signals. The different frequency response characteristics are due to the different sizes of the piezoelectric devices.

Another alternative embodiment includes a rectangular style bridge having a centrally located cutout wherein a piezoelectric device is mounted within the cutout to an edge of the bridge. A wire coil is fabricated and also connected to the bridge. The audio loudspeaker would then have permanent magnets mounted proximate to the bridge so that a magnetic flux is established orthogonal to the plane of the coil. The coil and piezoelectric device are then provided with an audio signal. The piezoelectric device would drive the diaphragm as described herein and the coil would drive the diaphragm as described in the above-referenced prior art patents, such as Paddock, U.S. Pat. No. 4,584,439. Again, the coil and the piezoelectric device could be tuned to provide a combination of mid-range and tweeter response characteristics.

The foregoing and additional features and advantages of the present invention will be more readily apparent from the following detailed description, which proceeds with reference to the accompanying drawings.

BRIEF DESCRIPTION OF THE DRAWINGS

FIG. 16 is an alternative embodiment of a diaphragm configuration of the present invention.

FIG. 17 is an alternative embodiment of a diaphragm configuration of the present invention.

FIG. 18 is an alternative embodiment of a diaphragm configuration of the present invention.

DETAILED DESCRIPTION OF THE PREFERRED EMBODIMENTS

Figure 1:
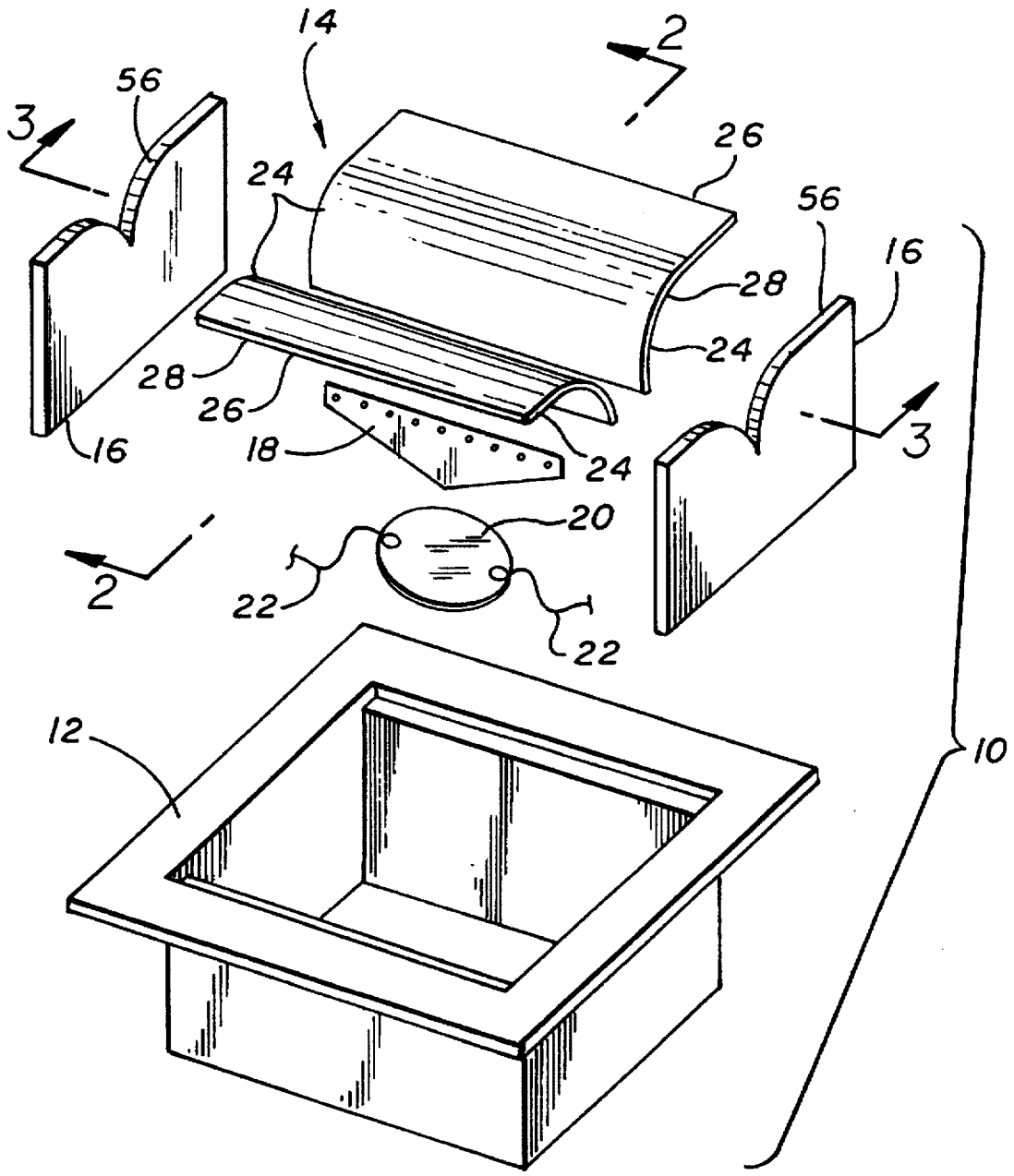
FIG. 1 is an exploded, perspective view showing the components of an audio transducer of the present invention.
Figure 2:
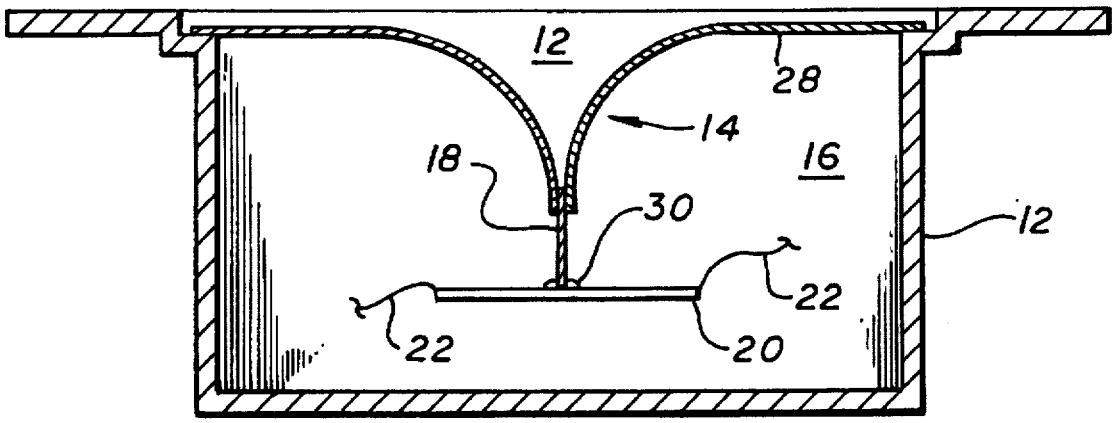
FIG. 2 is a cross-section, elevational view taken along line 2—2 of FIG. 1.
Figure 3:
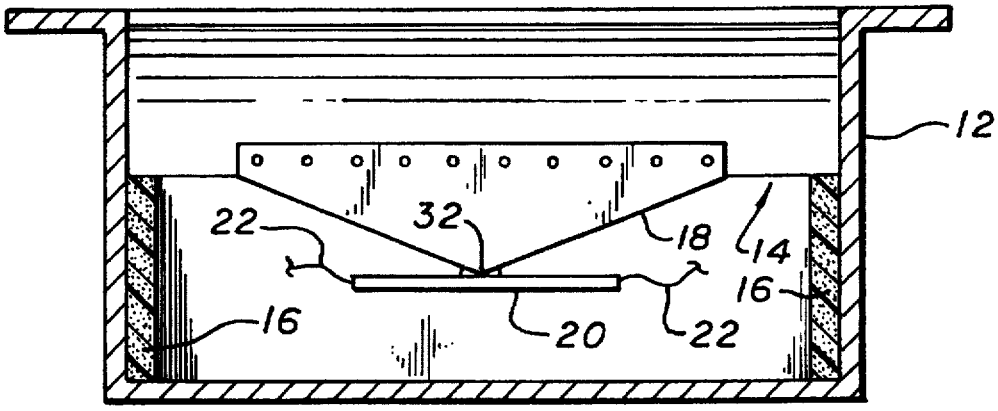
FIG. 3 is a cross-section, elevational view taken along line 3—3 of FIG. 1.

Referring generally to FIGS. 1–3 there is shown a preferred embodiment of an audio transducer 10 of the present invention. The audio transducer 10 has an enclosure 12 and a diaphragm 14 supported by two foam supports 16. Attached to the diaphragm 14 is a bridge 18, which in turn is attached to a piezoelectric device 20 having conductors 22 for connecting to a source of audio signals. The audio transducer 10 is primarily intended for use as an audio loudspeaker and the description of the transducer which follows will be addressed to its use as a loudspeaker. It should be understood, however, that a transducer is also suitable for, and functions quite effectively as, a microphone. Those skilled in the art would be able to easily convert the audio loudspeaker of the present design into a microphone.

As shown in FIGS. 1–3, the diaphragm is supported by the foam supports 16 along margins 24 and is attached to the enclosure 12 along margins 26. In the preferred embodiment shown, the diaphragm has two sheets 28 which connect to the bridge 18 and to each other through perforations in the bridge as will be explained below. The bridge 18 is attached to the piezoelectric device 20 by adhesive 30.

The piezoelectric device 20 is the driver for the audio transducer 10. Piezoelectric devices are well known in the art for their reliability in converting electrical energy into physical motion and vice versa. However, previous attempts to use piezoelectric devices with conventional loudspeaker diaphragms have proved troublesome because the audio fidelity generated by such combinations is poor. However, it has been found that when piezoelectric devices are used as a driver in LINEAUM style speakers, wherein the diaphragm has one or more sheets arranged as a flat, curvilinear plane, it has proved successful in producing high-fidelity audio loudspeakers. The present invention is particularly useful in providing speakers having good high frequency response, e.g. tweeters. Further experimentation may also reveal advantages for incorporating the present invention into speakers designed for low frequencies and base tones.

In the preferred embodiments disclosed herein the piezoelectric device 20 is a bimorph bender device manufactured by Motorola Corporation and sold as part number KSN6012A. The bimorph piezoelectric device has thin ceramic discs joined to a conductive material. When supplied with an audio signal, the bimorph piezoelectric device "dishes" in and out. It is also believed that crystals of the PZT family using a three component complex perobskite compound, are also suitable. Other piezoelectric devices include piezo ceramics of the cobalt-lead-niobate family and a unimorphis piezoelectric diaphragm consisting of one circular piezoelectric element and a circular metal plate which are adhered together. Other piezoelectric devices also are available to receive audio signals and produce physical motion, any of which may be suitable for use as a driver in the present invention.

As shown in the preferred embodiments, the piezoelectric device is unsupported within the enclosure 12 except for its adhesive connection to the bridge 18. Alternative embodiments include the use of a mounting pad that would consist of a low density foam connected to the piezoelectric device 20 and the enclosure 12. In this embodiment, the device 20 would be physically connected to the enclosure, not freely suspended. Another alternative embodiment includes the use of a tube having an outside diameter substantially equal to the diameter of the piezoelectric device 20 which is positioned to support the circumference of the piezoelectric device 20 and connect it to the enclosure 12. A soft tube would provide greater fidelity, a rigid tube would provide greater output, but at the expense of fidelity. Future development of the present invention may reveal other suitable support structures for supporting the piezoelectric device 20 and are considered within the scope of the present invention.

The bridge 18 is preferably a lightweight, rigid structure whose purpose is to transmit a point source of energy from the piezoelectric device 20 into a line driver for driving the diaphragm 14. One suitable material for the bridge 18 is a glass, epoxy board which is generally used in manufacturing flexible printed circuits. Bridges made of the glass, epoxy board have a thickness of 5 μm to 13 μm (0.002 inches to 0.005 inches). Furthermore, the glass, epoxy board may be easily cut into a desired physical configuration and it is suitable for attaching to the piezoelectric device 20 with an epoxy adhesive 30.

Figure 4:
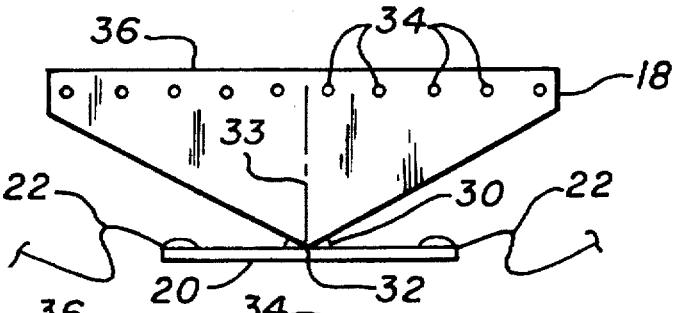
FIG. 4 is a detailed elevational view of a bridge and piezoelectric device of the present invention.

As stated, the purpose of the bridge is to convert a point source of excitation into a line source of excitation for driving the diaphragm 14. Predictably, the shape of the bridge can substantially effect the characteristics of the audio loudspeaker. A preferred embodiment of the bridge uses a shape that is substantially that of a triangle as shown in FIG. 4. It has been found that the optimum relative dimensions of the bridge are such that the ratio of the height 33 to a base margin 36 is between ¼ and ⅙. This preferred embodiment of the bridge also has two margins that form an apex 32 which is adhered to the piezoelectric device 20 by means of the adhesive 30. The bridge also has a line of perforations 34 that extend along margin 36.

The perforations 34 are used to connect the sheets 28 of the diaphragm 14 to the bridge 18 and to each other. As shown most clearly in FIG. 2, the sheets attach to opposite sides of the bridge 18. During fabrication, the sheets 28 will be aligned over the line of perforations 34 on the bridge 18. The sheets are then ultrasonically welded together through the perforations 34 using a suitably configured die. The perforations 34 may be either holes as shown, slits, elongated linear openings or other suitable openings that would permit the sheets 28 to be ultrasonically welded together through those openings. Other methods of connecting the sheets 28 to the bridge 18, such as by adhesive or mechanical connection, are also contemplated and are considered within the scope of the present invention.

Experimentation has shown that the preferred embodiment of the bridge 18 as shown in FIG. 4 may sometimes bow along its margin 36. Such bowing can cause distortion and degrade fidelity. However, such bowing can also improve the vertical dispersion of sound from the loudspeaker. A prototype unit has been shown to have approximately 90° of vertical dispersion which is adequate for many applications. However some applications require greater dispersion and alternative bridge configurations may provide greater bowing and thus greater dispersion, although there may be some degradation of low frequency output.

Figure 6:
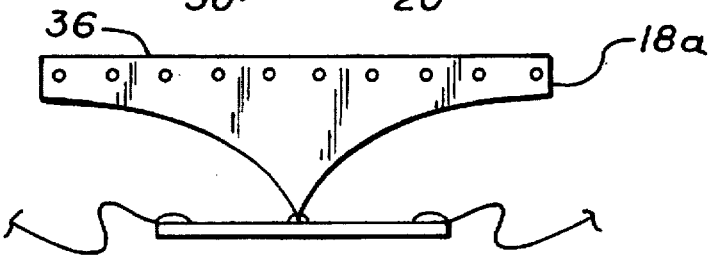
FIG. 6 is an alternative embodiment of a bridge of the present invention.
Figure 7:
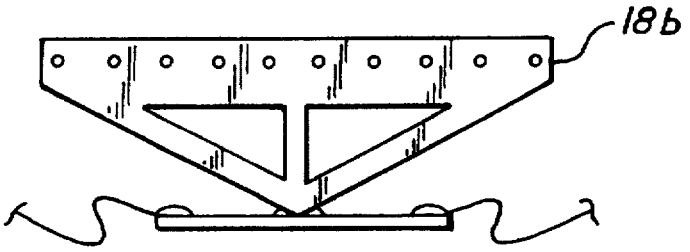
FIG. 7 is an alternative embodiment of a bridge of the present invention.
Figure 8:
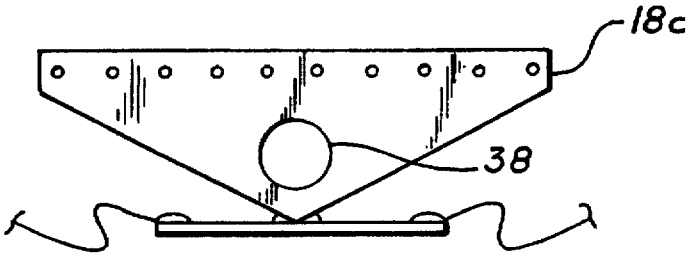
FIG. 8 is an alternative embodiment of a bridge of the present Invention.
Figure 9:
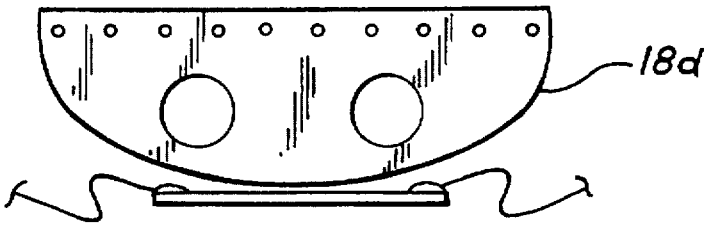
FIG. 9 is an alternative embodiment of a bridge of the present invention.

It also was noted during experimentation that the sound waves generated at the apex 32 of the bridge travel through the bridge structure at an equal rate and therefore reach different parts of the margin 36 at different times. As with the bowing, it is sometimes possible to take advantage of this feature to enhance certain characteristics of the bridge. At other times, it is desirable to defeat this feature in order to enhance other response characteristics. FIGS. 6, 7 and 9 show alternative bridge structures having a solid connection between the apex 32 and the center of margin 36 thereby enhancing the ability of the bridge to transmit sound waves to the center of the margin 36. Conversely, bridge 18*c* shown in FIG. 8 has a large aperture 38 located between the apex 32 and the margin 36 to attenuate the waves travelling from the apex to the center of the margin 36 thereby producing a more even response along the margin 36.

Figure 5:
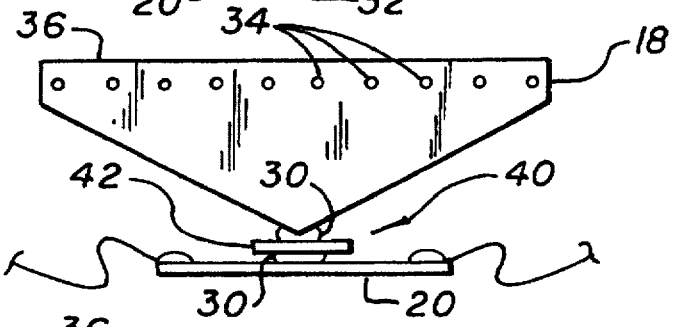
FIG. 5 is an alternative embodiment of a bridge of the present invention further showing a pad located between the bridge apex and a piezoelectric device wherein the pad acts as a low pass filter.

FIG. 5 shows a preferred embodiment of the present invention incorporating a low-pass filter 40 having a filter pad 42. The filter pad 42 comprises a thin pad of foam, preferably a closed-cell dense foam such as neoprene. Thin glue pads (not shown) are adhered to either side of pad 42 for use in connecting the pad to the bridge 18 and the piezoelectric device 20. Preferably, the glue pads are glass epoxy board similar to that used to construct the bridge 18, although other materials may be suitable and are within the scope of the present invention. The low-pass filter is adhered to the bridge 18 and the piezoelectric device using beads of epoxy adhesive 30.

Figure 10:
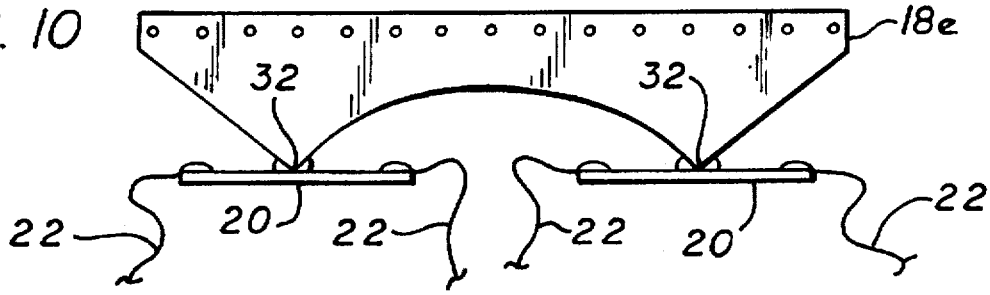
FIG. 10 is an alternative embodiment of a bridge of the present invention having two piezoelectric devices.
Figure 11:
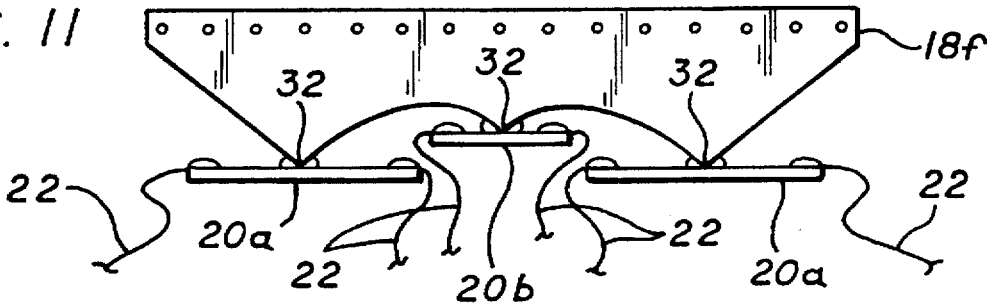
FIG. 11 is an alternative embodiment of a bridge of the present invention having three piezoelectric devices.
Figure 12:
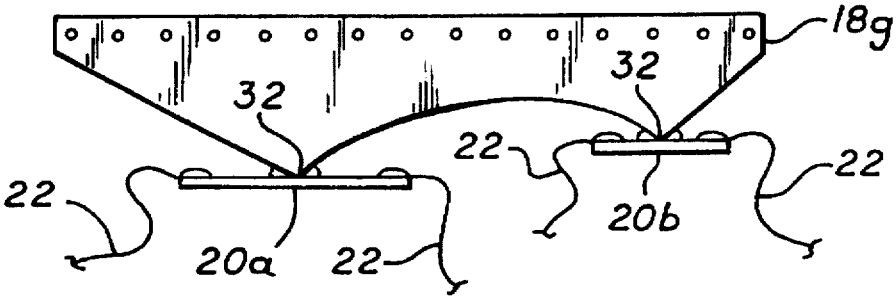
FIG. 12 is an alternative embodiment of a bridge of the present invention having two piezoelectric devices.

FIGS. 10–12 represent alterative embodiments incorporating two or more piezoelectric devices attached to a single bridge. Alternatively, it may be possible to use multiple bridges arranged along a coincident line. FIG. 10 shows a bridge having two apexes 32 to which are mounted two piezoelectric devices 20. This design may be useful for producing greater audio output from the audio transducer 10. FIG. 11 shows a bridge 18*f* having three apexes 32 and two large piezoelectric devices 20*a* and a smaller piezoelectric device 20*b*. This configuration may be useful for providing high-frequency and midfrequency response. No crossover network would be necessary. It is envisioned that the conductors 22 of all the piezoelectric devices 20*a* and 20*b* would be connected to the same audio source. The smaller piezoelectric device 20*b* would provide greater high frequency response due to its smaller size.

FIG. 12 is a further alternative embodiment showing bridge 18*g* having two apexes 32 which are attached to piezoelectric devices 20*a* and 20*b*. As with the embodiment shown in FIG. 11, the smaller piezoelectric device 20*b* would produce greater higher frequency response while the larger piezoelectric device 20*a* will provide a response at a somewhat lower frequency. The bridges 18*f* and 18*g* shown in FIGS. 11 and 12 are particularly suitable for incorporation of the lowpass filter 40. Preferably the filter 40 would be used between piezoelectric devices 20*a* and their respective apexes to attenuate higher frequencies.

Figure 13:
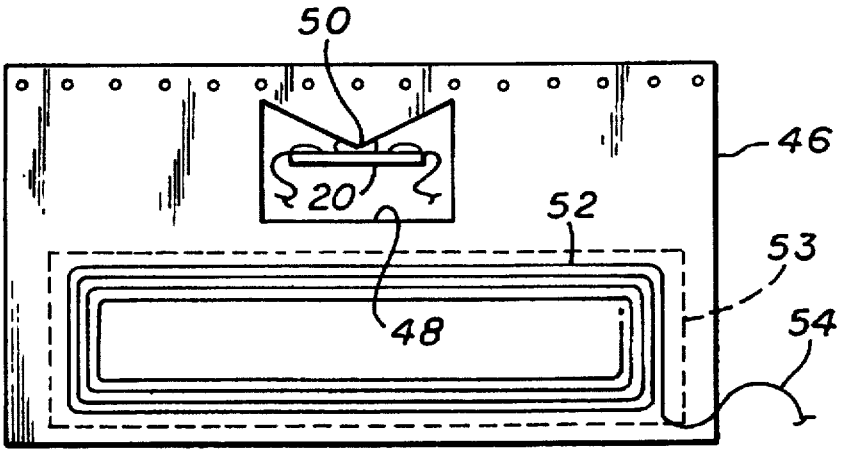
FIG. 13 is an alternative embodiment of a bridge of the present invention further including a coil.

FIG. 13 shows another embodiment of the present invention wherein a bridge 46 has a cutout 48 having two margins that form an apex 50 to which is mounted a piezoelectric device 20. Also mounted to the bridge 46 is an electrically conductive coil 52 which can be connected to an audio signal source by one or more conductors such as conductor 54. As previously noted, the prior art includes several other examples of tangentially driven diaphragm speakers using an electro-magnetic driver, one example of which is shown in Paddock, U.S. Pat. No. 4,584,439 which is hereby incorporated herein by reference. In the prior art patent, an electrically conductive coil was located between two diaphragm sheets and positioned between a permanent magnet so that when the coil was electrically energized a magnetic flux was established thereby moving the diaphragm between the transversely mounted magnets. Similarly, the bridge 46 may be located between a permanent magnet 53, and an audio signal may be supplied to conductor 54 thereby energizing coil 52 to create a variable magnetic flux which will cause bridge 46 to move in response to the changing magnetic flux. The audio signal supplied to the coil may also be supplied to the piezoelectric device 20 thereby driving the audio transducer to provide a more full range of frequency response.

The diaphragm 14 preferably has two sheets 28 each arranged as a flat, curvilinear plane which, for the purposes of the specification and the claims that follow, is defined as a surface defined by a straight line moving transversely through space along a curved path. In the preferred embodiment shown in FIGS. 1–3 each sheet 28 has a relatively simple, single curve, but it is contemplated that other embodiments could incorporate a greater number of, or more complex, curves. It is an important feature of the present invention that the diaphragms are curved in one direction only and remain linear in an orthogonal direction. Referring to FIG. 1, it is seen that the margin 26 is a straight line whereas the margins 24 form curvilinear lines. The diaphragm sheets 28 are designed such that the surface between the margins 24 of a particular sheet 28 will always be a straight line: thus the designation, flat, curvilinear plane.

As shown in FIGS. 1–3, a preferred embodiment of the present invention has a diaphragm 14 using two sheets 28 incorporating the simple curve as shown. The bridge is located between the sheets such that its major plane is tangent to the curvature of the sheets at the point of its connection to the sheets. In all embodiments of the present invention the bridge will connect to the sheets along a plane substantially tangent to a curvature of the plane of the sheets at the point of connection. Thus, the diaphragms in all embodiments of the present invention are tangentially driven diaphragms.

Figure 14:
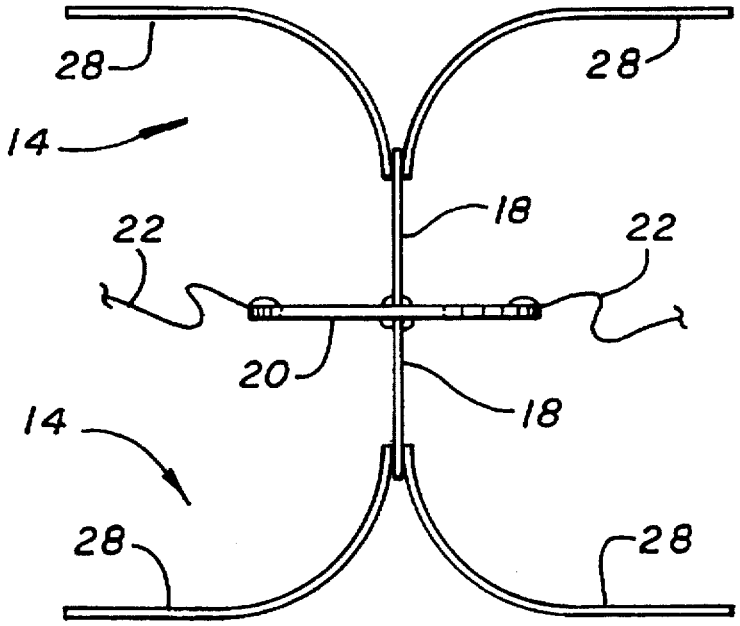
FIG. 14 is an alternative embodiment of a diaphragm configuration of the present invention.
Figure 15:
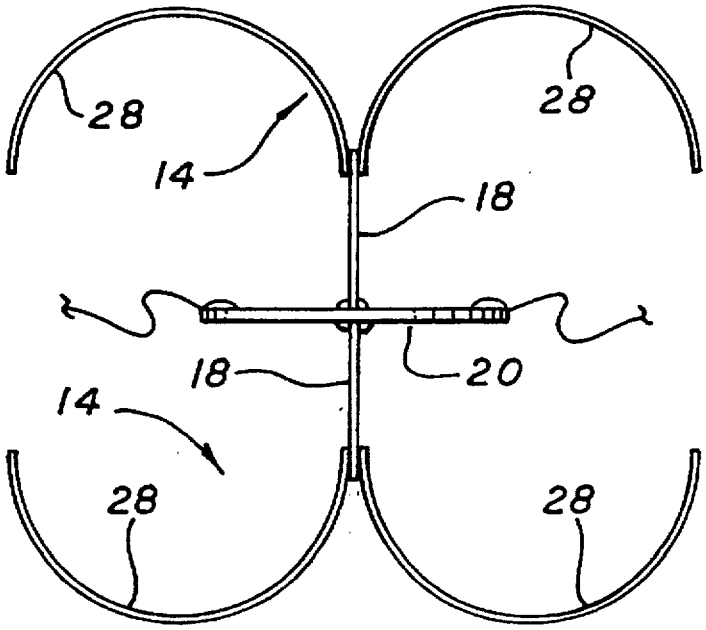
FIG. 15 is an alternative embodiment of a diaphragm configuration of the present invention.

Alternative embodiments of the diaphragm 14 are shown if FIGS. 14–18. FIG. 14 shows two diaphragms 14 having a total of four sheets 28 which are mounted to two individual bridges 18 which are adhered to opposite sides of a single piezoelectric device 20. FIG. 15 represents another double diaphragm configuration wherein diaphragm sheets 28 have a greater degree of curvature. FIG. 16 discloses another embodiment similar to that shown in FIG. 1, but wherein the sheets 28 have a greater degree of curvature. FIGS. 17 and 18 disclose further embodiments wherein a single diaphragm sheet 28 is mounted to a single bridge on one side of a piezoelectric device 20 and the configuration is repeated on the opposite side. FIG. 18 is similar to that of FIG. 17 except that one of the sheets 28a is a different size. Alternatively, the configurations shown in FIGS. 17 and 18 could comprise a single sheet and a single bridge mounted to only one side of the piezoelectric device 20.

A preferred material for the diaphragm sheets 28 is polypropylene film. Alternative films that are suitable for the sheets 28 include polyvinylhalides and polyalkylenes. It will be appreciated that other diaphragm materials also may be used.

The foam supports 16 are mounted within the enclosure 12 and support the diaphragm 14. As shown in FIG. 1, the foam support 16 is a flat plane having a margin 56 that is configured to the preferred shape for the sheets 28 of the diaphragm 14. Preferably the foam supports 16 are of a closed cell foam such as neoprene or urethane. A foam sold under the brand name SORBATHANE has proved satisfactory in prototype units. The desirable properties for the foam are that it be die cuttable and attenuate sound energy. In an alternative embodiment foam supports are used to support margins 26 and margins 24.

The enclosure 12 is preferably of a molded plastic and may have any shape suitable to enclose and contain the components of the loudspeaker. Alternatively, it is contemplated that the loudspeaker could comprise only the diaphragm 14, bridge 18, support 16 and piezoelectric device 20 mounted onto a foam backing so that it could be easily adhered to any surface.

In view of these and the wide variety of other embodiments to which the principals of the invention can be applied, the illustrated embodiments should be considered exemplary only and not as limiting the scope of the invention.

I claim as the invention all such modifications as may come within the scope and spirit of the following claims and equivalents thereto.

What is claimed is:

1. An audio transducer, comprising:

(a) a nonmagnetic transducer that converts energy between electric energy and physical motion;

(b) a diaphragm having at least two flexible sheets arranged as a flat, curvilinear planes; and (c) a bridge having a first end and a second end wherein the first end has a first area of contact that is coupled to the nonmagnetic transducer and the second end has a second area of contact that is coupled to the diaphragm and the first area of contact is less than the second area of contact so as to convert a point source of excitation at the nonmagnetic transducer into a line source of excitation at the diaphragm.

2. The audio transducer of claim 1 wherein the nonmagnetic transducer is a piezoelectric device.

3. The audio transducer of claim 1 wherein a major surface of the bridge defines a linear plane that is substantially tangent to a curvature of the flat, curvilinear planes.

4. The audio transducer of claim 1 wherein the bridge is substantially triangular having margins that define an apex and a base and wherein the apex is connected to the nonmagnetic transducer and the base is connected to the diaphragm.

5. The audio transducer of claim 1 wherein the bridge defines at least one aperture located between the first end and the second end, wherein the aperture attenuates waves propagating through the bridge.

6. The audio transducer of claim 1 wherein the bridge further comprises a filter pad which is connected to the nonmagnetic transducer.

7. An audio transducer, comprising:

(a) a nonmagnetic transducer that converts energy between electric energy and into physical motion;

(b) a tangential junction diaphragm having two sheets that are respectively arranged as flat, curvilinear planes and are connected together along a junction plane that is substantially tangent to a curvature of the respective flat, curvilinear planes; and (c) a bridge connected to the nonmagnetic transducer wherein the bridge includes an elongate, substantially-linear margin coupled to the diaphragm proximate to the junction plane and side margins extending from the elongate margin that define an apex which is connected to the monmagnetic transducer so that motion of the nonmagnetic transducer is transferred to the diaphragm by the bridge.

8. The audio transducer of claim 7 wherein the nonmagnetic transducer is a piezoelectric device.

9. The audio transducer of claim 7 wherein the bridge defines at least one aperture that is located between the apex and the elongate margin to attenuate waves propagating through the bridge.

10. The audio transducer of claim 7 wherein the bridge further comprises a filter pad which is connected to the nonmagnetic transducer.

11. The audio transducer of claim 7 wherein a major surface of the bridge defines a bridge plane which is substantially coincident with the junction plane.

12. The audio transducer of claim 7 wherein the bridge is connected to the two sheets and located between the two sheets.

13. The audio transducer of claim 7 wherein the bridge defines at least one perforation proximate the margin and the two sheets are joined together through the at least one perforation thereby connecting the sheets together and connecting the sheets to the bridge.

14. An audio transducer, comprising:

(a) a plurality of nonmagnetic transducers, each converting energy between electric energy and physical motion;

(b) a tangential junction diaphragm having two sheets that are respectively arranged as flat, curvilinear planes and are connected together along a junction plane that is substantially tangent to a curvature of the respective flat, curvilinear planes; and (c) bridge connected to the nonmagnetic transducer wherein the bridge includes an elongate, substantially-linear margin coupled to the diaphragm proximate to the junction plane and margins that define a plurality of apexes, each of which are connected to a separate nonmagnetic transducer so that motion of the nonmagnetic transducers is transferred to the diaphragm by the bridge.

15. The audio transducer of claim 14 wherein the bridge further comprises a plurality of filter pads connected to the plurality of apexes and connected to respective nonmagnetic transducers.

16. An audio transducer, comprising:

(a) a nonmagnetic transducer that converts energy between electric energy and physical motion, the nonmagnetic transducer having a first major side and a second major side;

(b) a first tangential junction diaphragm having two sheets that are respectively arranged as a flat, curvilinear plane and the two sheets are connected together;

(c) a second tangential junction diaphragm having two sheets that are respectively arranged as a flat, curvilinear plane and the two sheets are connected together;

(d) a first bridge; and (e) a second bridge, wherein the first bridge is connected to the first major side of the nonmagnetic transducer and the second bridge is connected to the second major side of the nonmagnetic transducer and the first bridge is further connected to the first tangential junction diaphragm and the second bridge is further connected to the second tangential junction diaphragm.

17. An audio transducer comprising:

(a) at least one nonmagnetic transducer that converts energy between electrical energy and physical motion;

(b) a diaphragm, the diaphragm defining an axis of movement;

(c) a card connected to the diaphragm and defining at least one cutout and having the at least one nonmagnetic transducer connected to the card within the cutout, the card further having a major surface defining a plane, the major surface being parallel to the diaphragm axis of movement;

(d) a coil affixed to the major surface of the card so that the coil is substantially planar;

(e) at least one magnet device generating a magnetic field with magnetic flux orthogonal to the plane, wherein electrical signals are provided to the nonmagnetic transducer and the coil and the signals provided to the nonmagnetic transducer are converted into physical motion that urges the card to move and the signals provided to the coil are converted into magnetic flux which interacts with the at least one magnet device thereby also urging the card to move, and wherein motion of the card drives the diaphragm to create sound.

18. The audio transducer of claim 17 wherein each nonmagnetic transducer is a piezoelectric device.

19. The audio transducer of claim 17 wherein the at least one magnetic device is at least one permanent magnet.

20. An audio transducer comprising a diaphragm having two curved sheets and a driving piezoelectric element, the sheets being interconnected to the driving piezoelectric element through a substantially planar bridge, the bridge defining at least one perforation wherein the curved sheets are ultrasonically welded together through at least one perforation.

21. The audio transducer of claim 20 wherein the ultrasonic weld is a continuous line.

22. The audio transducer of claim 20 wherein the ultrasonic weld is a plurality of line segments.

23. The audio transducer of claim 20 wherein the ultrasonic weld is a plurality of spot welds.

24. An audio transducer, comprising:

(a) a nonmagnetic transducer that converts energy between electric energy and physical motion;

(b) a tangential junction diaphragm having two sheets that are respectively arranged as flat, curvilinear planes and are connected together along a junction plane that is substantially tangent to a curvature of the respective flat, curvilinear planes; and (c a bridge connected to the nonmagnetic transducer and the diaphragm and located between the nonmagnetic transducer and the diaphragm wherein the bridge defines at least one perforation and the two sheets are ultrasonically welded together through the at least one perforation thereby connecting the sheets together and connecting the sheets to the bridge.

25. An audio transducer, comprising:

(a) at least one nonmagnetic transducer that converts energy between electrical energy and physical motion;

(b) a diaphragm, wherein the diaphragm is a tangential junction diaphragm having two sheets that are respectively arranged as flat, curvilinear planes and the two sheets are connected together along a junction plane that is tangent to a curvature of the respective flat curvilinear planes;

(c) a card connected to the diaphragm and defining at least one cutout and having the at least one nonmagnetic transducer connected to the card within the cutout, the card further having a major surface defining a plane;

(d) a coil affixed to the major surface of the card;

(e) at least one magnet device generating a magnetic field with magnetic flux orthogonal to the plane.

26. The audio transducer of claim 7 wherein the bridge is fabricated from a substantially rigid material.

* * * * *